United States Patent [19]

Henson

[11] 3,960,330

[45] June 1, 1976

[54] METHOD FOR MAXIMIZING THROUGHPUT IN AN ORE GRINDING SYSTEM

[76] Inventor: Howard K. Henson, 1134 E. Lester, Tucson, Ariz. 85719

[22] Filed: June 21, 1974

[21] Appl. No.: 481,539

[52] U.S. Cl. ..... 241/30; 241/34

[51] Int. Cl.[2] ..... B02C 25/00

[58] Field of Search ..... 241/30, 33, 34

[56] References Cited

UNITED STATES PATENTS

| | | | |
|---|---|---|---|
| 2,764,360 | 9/1956 | Podszus | 241/34 |
| 3,253,744 | 5/1966 | MacPherson et al. | 241/34 X |
| 3,350,018 | 10/1967 | Harris et al. | 241/34 |
| 3,351,294 | 11/1967 | Hayes | 241/34 |
| 3,471,094 | 10/1969 | Kearney et al. | 241/34 X |

*Primary Examiner*—Granville Y. Custer, Jr.
*Attorney, Agent, or Firm*—J. Michael McClanahan

[57] ABSTRACT

A system for optimizing ore throughput in an ore mill grinding system comprising means for direct weighing of the grinding system including the drive means, means for weighing the new ore input, and controller means regulating the new ore input to achieve maximum efficiency of ore grinding utilizing heuristic problem solving method which also prevents grinding system overload while permitting maximum ore throughput. Changes in grinding system parameters due to grinding media wear and ore grindability are automatically compensated by the controller means.

5 Claims, 3 Drawing Figures

METHOD FOR MAXIMIZING THROUGHPUT IN AN ORE GRINDING SYSTEM

BACKGROUND OF THE INVENTION

In present day industrial scale grinding systems, fine grinding of minerals or other substances is accomplished in large cylindrical rotating grinding chambers referred to as ball mills, rod mills, pebble mills, or autogenous mills which employ steel balls, steel rods, pebbles, or large pieces of ore respectively as the grinding media and from which the name of the mill is derived. The new ore, or other mineral or substance to be ground, is directed into the grinding chamber at one end of the rotating cylinder, and the ground ore, commonly referred to as fines, is removed at the other end. The mills are charged with the grinding media, i.e., steel balls, rods, etc., as needed. The mills are of the overflow or grate discharge types employing either dry or wet grinding. Dry grinding is used primarily for cement manufacture and wet grinding primarily in metal ore applications. In wet grinding, a slurry is made of the ore and a fluid, usually water. The efficiency of wet grinding depends upon the slurry consistency, grinding media, and the mill inventory consisting of the ore in the grinding chamber. Dry grinding efficiency depends only upon the mill inventory and grinding media.

Control of the slurry consistency has been the subject of considerable research and successful methods have been found to control this parameter. Accurate control of mill inventory, however, has eluded investigators. Mill inventory effects ore throughput of the grinding system in the following way: if the ore to grinding media ratio is too small, the grinding media grinds against itself and the mill liners causing excessive wear; if the ratio is too large, the ore and water slurry cushions the impact of the falling grinding media and restricts its movement. FIG. 1 illustrates the relationship of ore throughput to the ore weight in the mill, remembering that the weight of all components in the mill grinding chamber, except ore are essentially constants, i.e., water, or are changing at known rates, i.e., the wearout rate of the grinding media and thus the associated weight change is known. See for example, *Inventory Control of Grinding Mills Using Bearing Pressure Measurement*, D. J. Oswald and J. G. Ziegler, Transactions, Society of Mining Engineers, AIME, Vol. 254, Sept., 1973, pp. 201–205.

In the past, large amount of research has been expended on mill inventory control using indirect variables such as the mill drive motor power draw, the sound eminating from the grinding chamber, and the circulating load. The first method above has not been successful inasmuch as there is a detectible change in power consumption only after the mill has reached a point of overload. Sound detection methods are not satisfactory because the sound produced in the grinding chamber is not closely related to the mill inventory. Circulating load (which refers to the insufficiently ground ore which egresses the grinding chamber, but is returned to the mill by separators or classifiers for regrinding) measurements are unsatisfactory because of difficulty in measuring the circulating load, and circulating load is not necessarily a proportional indicator of the mill inventory, especially if the mill has reached a point of plugging up.

Using these control methods, most mills operate at a point below the peak of maximum throughput vs. mill inventory. The difference between the average operating point and peak throughput has been estimated to be in the range of 5 to 20 percent below peak throughput.

Control of mill inventory by sensing the mass of the mill and content has been attempted before, see for example, U.S. Pat. No. 3,350,018, which uses pressure of the oil lubrication film of supporting mill journals to sense the weight. However, the method there described suffers from low sensitivity to mill inventory change, inaccuracies due to oil viscosity variation and temperature effects, and further, the system fails to take into account weight changes which are due to grinding media and mill liner wear. Additionally, the above system fails to account for the variable vertical forces applied to the mill by the drive means but which simulate inventory changes.

The low sensitivity problem, which affects all direct mass measurement methods, is due to the large ratio of mill and grinding media weight to ore weight, typically in the range of 25 to 1. If the inventory resolution required is plus or minus 2.5%, a mass resolution of plus or minus 0.1% is required. Recent advances in low drift electronics and load cells of the flat type have made measurements of this accuracy possible and relatively inexpensive. Flat load cells are also stiff enough to prevent mechanical misalignment problems. But still further, any direct mass measuring system must account for grinding media and mill liner wear, however, inasmuch as the rate of wear of the crushing medium and mill liners is approximately known, the relative substantial change in the total weight of the mill and mill inventory through the course of the day can be estimated fairly closely.

The exact curve of ore throughput versus weight of the ore in the mill is not known. However, it is known that the curve is unimodal and its general shape is as shown in FIG. 1. As can be seen by FIG. 1, there is a point of maximum efficiency where on either side of this point the mill is not operating at maximum efficiency. It is the determination of this point of maximum efficiency and the operation of the mill at that point thereafter to which this invention is directed.

SUMMARY OF THE INVENTION

The present invention comprises a method and means by which the optimum performance and maximum efficiency of an ore mill grinding system may be achieved and continued during the grinding system's operation. More specifically, the invention measures the total weight of an ore mill grinding system including the drive means by the use of load sensors, the output of which is directed to controller means which regulates the ore input to the grinding mill. The controller means receives as input the outputs of the load sensor measuring the total weight of the grinding system.

The controller means comprise two control loops, the first loop of which controls the new ore feed and the second control loop provides a grinding system weight reference set point to control loop 1. Control loop 1 thus adjusts the new ore feed rate to maintain the mill weight at the set point furnished it by control loop 2. Control loop 2 receives input of the weight of the mill, the weight of the new feed added, and the weight of new grinding media when it is added.

Control loop 2 determines grinding system weight versus throughput over a chosen period of time from these inputs and through the use of a heuristic or "hill climbing" algorithm, locates and tracks the weight of the mill, including the mill inventory, which results in a maximum throughput. Predictable shifts in the weight of the mill due to grinding media wear or the mill being newly charged with grinding media, and unpredictable effects such as, for example, drift in the weight sensors or changes in ore type, do not seriously effect the throughput as the inherent operation of the control loop 2 compensates for such changes as they occur. Thus at all times, the operation of the grinding system mill is maintained near the point of maximum possible throughput.

Accordingly, it is an object of the present invention to optimize the performance of an ore grinding system by controlling the weight of the system to a predetermined amount by control of new ore feed into the grinding system.

It is also an object of the present invention to provide means to adjust the predetermined grinding system weight to maximize the efficiency of the grinding system and to maintain the efficiency of the grinding system at maximum.

It is further an object of the present invention to maximize the throughput of an ore grinding system by varying the weight of the ore grinding system in a heuristic manner by sensing the grinding system throughput in relationship to the grinding system weight.

DETAILED DESCRIPTION

Figure 2:
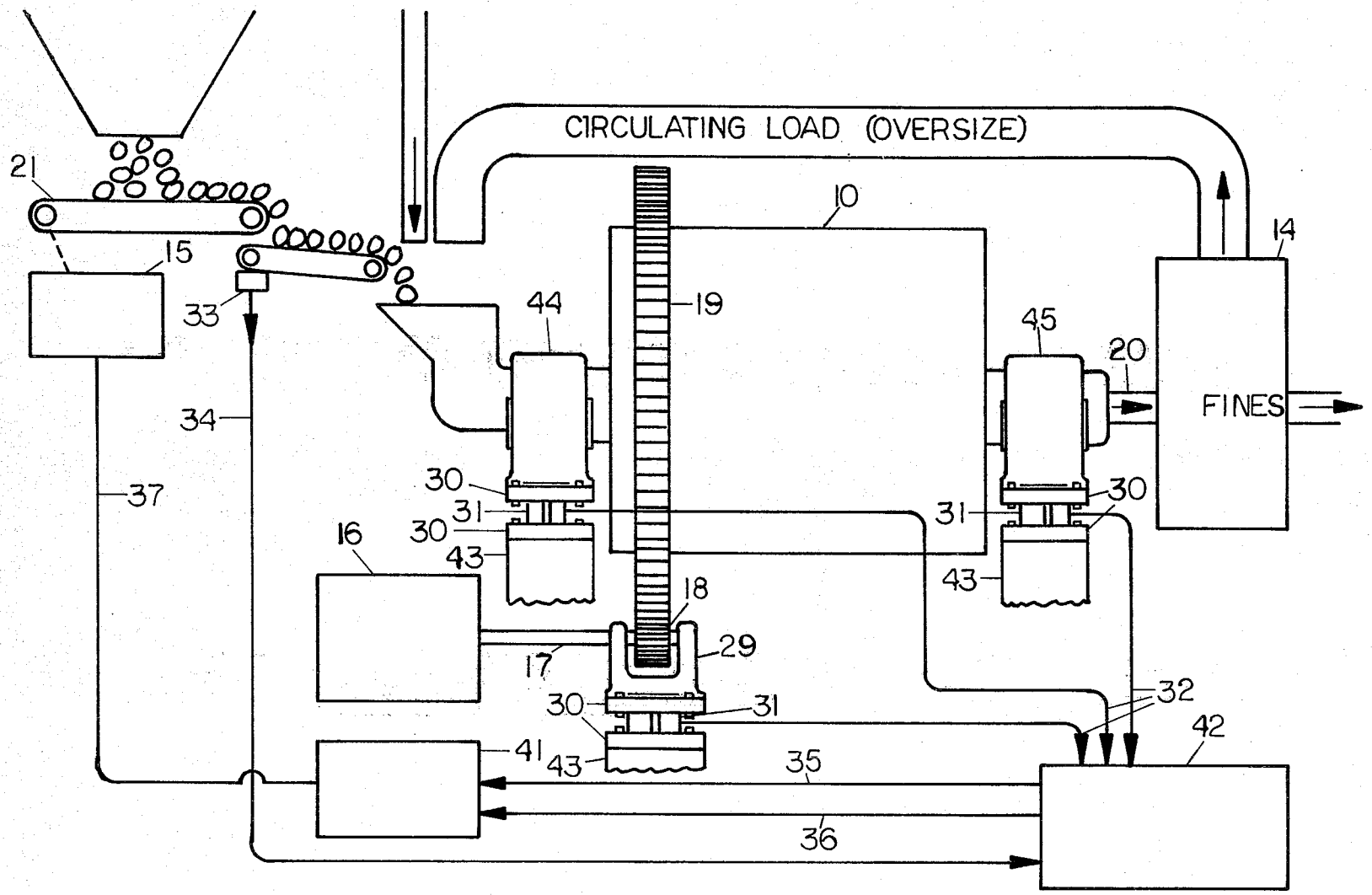
FIG. 2 is a schematic diagram of the overall grinding system and its controller means.

Referring now to FIG. 2, mill 10, through its journals 44 and 45, rests upon load sensors 31, which are of a commercially available type, such as Interface mode 1121 load cells, having load distribution plates 30 above and below load sensors 31, each with a commercially available load indicator, such as Interface model 7100 indicator with analog output (not shown). Similarly the pinion gear load bearings 29 are supported on load sensors 31, which are of a commercially available type, such as Interface model 1111 load cells, similarly situated between load distribution plates 30 with commercially available load indicators as above. Load sensors 31 in turn rest on concrete piers 43.

Analog signals from load sensors 31 are directed to controller 42 by means of information lines 32. Controller 42 performs those functions hereinafter described and may be of a commercially available type, such as an IBM S/7 computer with IBM model 5012 multifunction module with operator station IBM 5028. Controller 42 determines the total weight of the mill by adding together load sensor 31 outputs. This value, the current weight of the mill, is directed to controller 41 over information line 35. Controller 41, which performs those functions hereinafter described and may be of a commercially available type, such as a Honeywell Vutronik specification S-366-4. The set point, which is described hereinafter, is directed by controller 42 to controller 41 over information lines 36.

The output of controller 41 is directed over line 37 to feed drive means 15 which drives new feed mechanism 21. Controller 41 compares the current weight of the mill computed by controller 42 with the set point weight given it by controller 42 and will increase or decrease the new ore feed rate to maintain the weight of the mill in accordance with this set point.

In addition to mill 10 weight information from load sensors 31, controller 42 also receives from belt scale 33 through line 34 the weight of new feed entering the grinding circuit. Belt scale 33, which weighs the new ore, emits signal every time an increment of weight passes the scale. A suitable belt scale would be a Ramsey Engineering VEY-R with pulse output.

The function of controller 42 is to optimize the grinding circuit throughput, i.e., the fines 20 passed to further process by classifier 14. If the amount of ore within the grinding circuit is maintained constant (the task of controller 41) the new ore feed measured by belt scale 33 will represent the throughput of the mill over some period of time, thus locating a point along the throughput versus inventory curve of FIG. 1.

A number of "hill climbing" or heuristic algorithms could be applied to optimize grinding circuit performance, given this ability to determine throughput versus weight data (inventory being inferred from weight). A specific example follows: upon the initial startup of the mill from a nonoperational (no ore inventory) status, a nominal ore inventory will be added by controller 42 to the weight computed by controller 42 as measured by load sensors 31 and is the value used for the set point of controller 41. After the weight measured by load sensors 31 has stabilized, the grinding system input as measured by belt scale 33 will be accumulated in controller 42 over a period of time, for example 15 minutes. At the end of this time a grinding system throughput (tons per hour) and an average weight (tons) will be computed by controller 42. As there is no prior knowledge of this throughput in relation to the maximum possible, or even in which direction the weight should be changed to improve throughput, these values will be stored in controller 42 and the set point for controller 41 changed an incremental amount up or down by controller 42. The size of this increment will depend on the specific mill to which the invention is applied but must be large enough to result in measurable change in throughput provided the inventory is off the peak of the throughput versus inventory curve. After the weight measured by the load sensors 31 has stabilized, throughput and average weight over a period of time is again accumulated by controller 42. The new throughput and weight information may now be compared with the original throughput and weight data stored in controller 42 and a decision made as to the direction of weight change which will improve throughput, i.e., the next incremental change in the set point of controller 41 will be in the same direction as the last change if an increase in throughput has occurred and in the opposite direction if a decrease in throughput has occurred. The new throughput and weight information will now be stored and the cycle repeated. This control strategy will cause the set point of controller 41 to oscillate about the point of maximum throughput and will track this point as changes in system parameters occur.

An improvement in this control strategy is made by superimposing upon the set point of controller 41 weight changes known to occur due to wear out and addition of grinding media. Controller 42 would then subtract from each new set point applied to controller 41 an amount equal to the weight loss of the media due to wear out over the time interval since the last set point was applied to controller 41, or add to the set point of controller 41 a value equal to the weight of new media when it is added. The wear out rate of media and liners in pounds per hour is usually known for each mill and in common practice new grinding media is weighed and added once each day. This weight is entered through the operator station.

Figure 3:
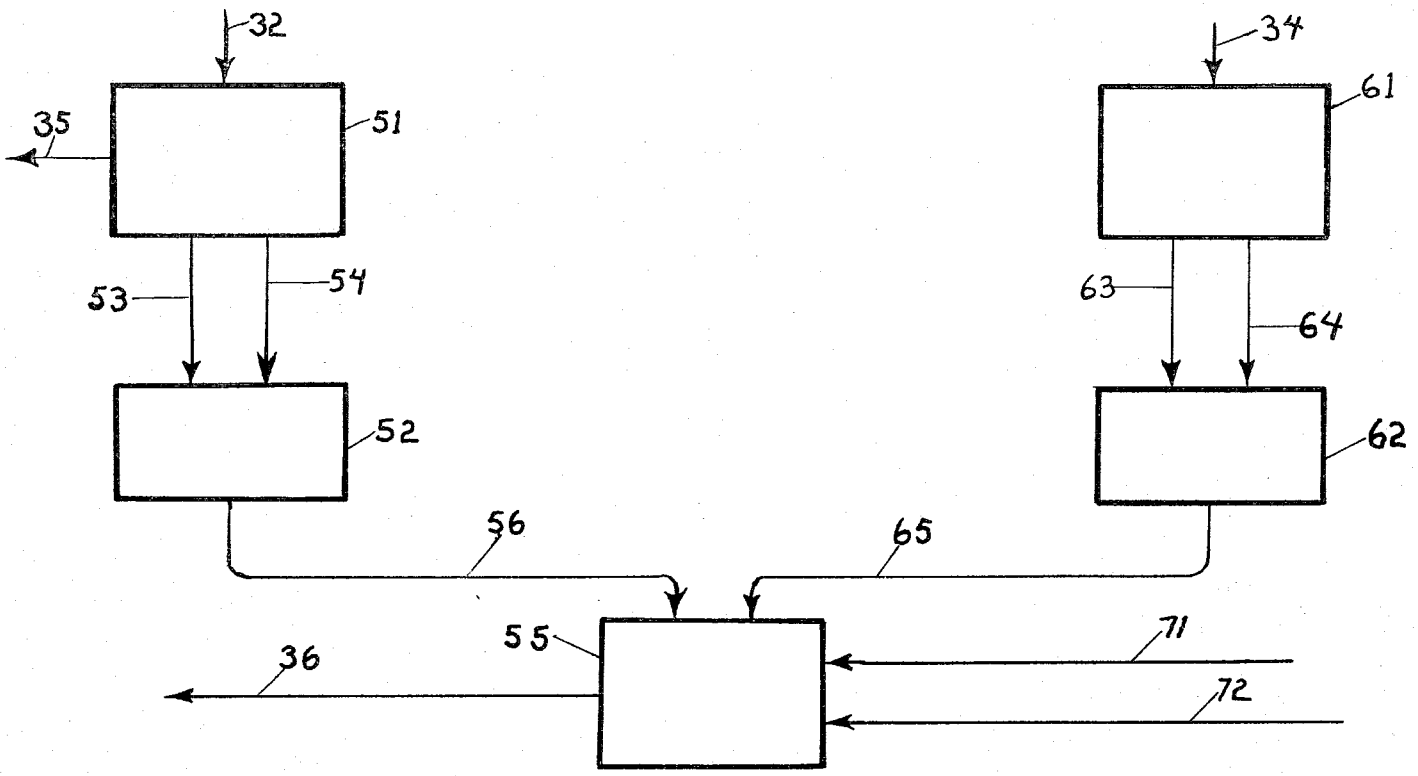
FIG. 3 is a schematic diagram of the controller means.

The specific operations of controller 42 are illustrated in FIG. 3 in a conceptual manner as follows.

The weight of the mill and drive means 16, 17, 18 and 19 pinion gear load bearings 29 is directed to block 51 by means of lines 32. Block 51 averages the weight received over consecutive time periods and stores this average for each time period, for example, time period 1 and consecutive time period 2. The average weight determined for time period 1 and for time period 2 are directed respectively to block 52. Block 52 compares the average weight of the mill over time period 1 with the average weight for time period 2 and provides an output designating whether there was an increase or decrease in mill weight. This output is directed to block 55 by means of line 56.

Figure 1:
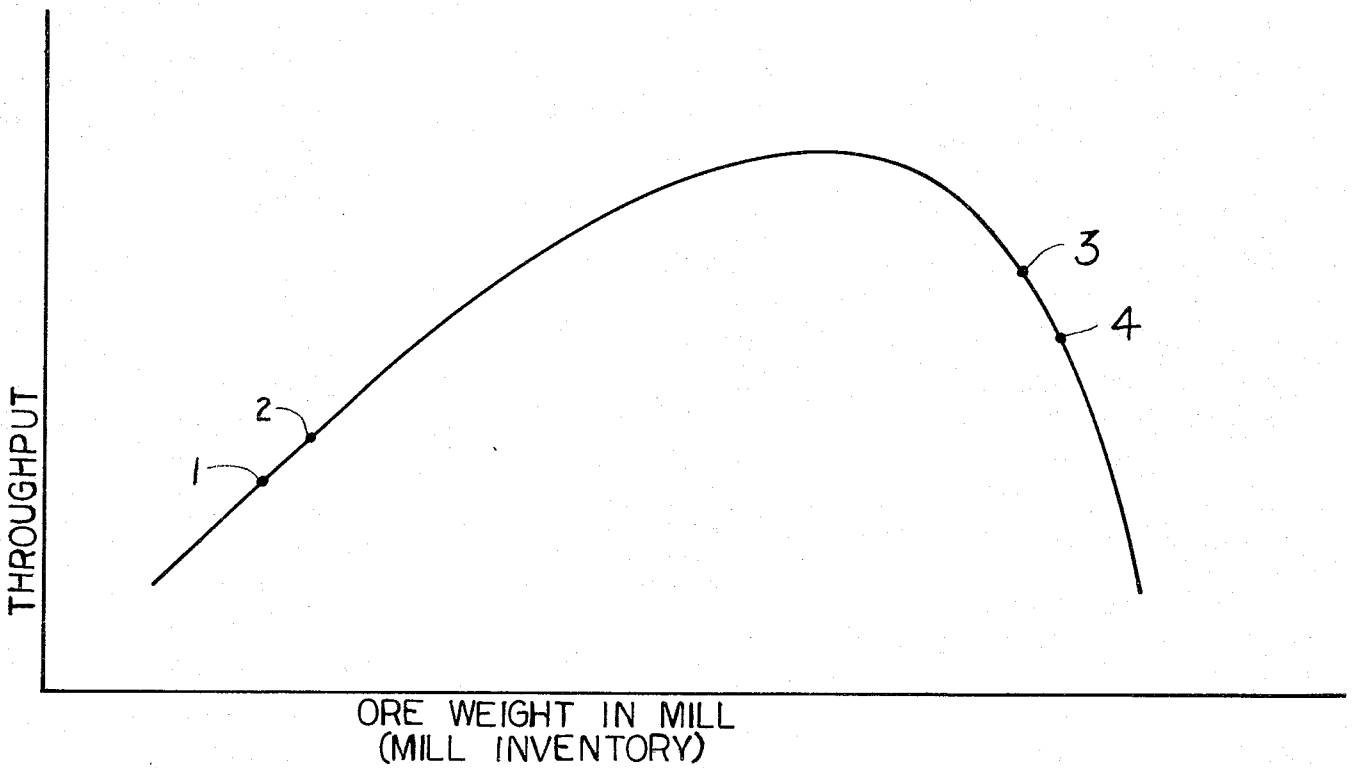
FIG. 1 is a graph showing the ore grinding efficiency curve.

Reference may now be made to FIG. 1 illustrating the throughput versus the ore weight in mill (mill inventory) curve. As previously indicated, the weight of all other parameters in the mill is essentially constant with the exception of the ore content. This is especially so over the time period herein considered. As may be seen, if the mill weight increases in going from time period 1 to time period 2, the curve of FIG. 1 is being traced from representative point 1 to representative point 2 or from representative point 3 to representative point 4. Conversely, if the mill weight decreases from time period 1 to time period 2, the curve of FIG. 1 is being traced from point 2 to point 1 or point 4 to point 3.

The new ore feed weight as determined by belt scale 33 is directed to block 61 by means of line 34. Block 61 performs the function of adding the accumulated ore feed over the selected period of time for the time periods 1 and 2 and stores the amounts determined. The amounts accumulated and stored are directed to block 62 through lines 63 and 64. Block 62 compares the amount of new ore fed into the mill during time period 1 with that amount of ore fed into the mill during time period 2. The output of block 62 is an indication of whether there has been an increase or decrease in the amount of new ore fed into the mill from time period 1 to time period 2. Going now to FIG. 1, in the case of an increase in new ore it can be seen that the mill will be moving along the curve from point 1 to point 2 or from point 4 to point 3. In the event that block 62 indicates that there has been a decrease in new ore from time period 1 to time period 2, the mill is traversing the curve FIG. 1 from point 2 to point 1 or from point 3 to point 4.

The output of block 62 is directed to block 55 by means of line 65. Block 55 then takes the output of blocks 52 and 62, and for the case of an increase in mill weight as indicated by block 52 and an increase in new ore feed as indicated by block 62 indicating that the mill has traversed the curve of FIG. 1 from point 1 to point 2, in which case block 55 will increase the set point by a certain defined increment. In the case that mill weight has decreased in going from time period 1 to time period 2 and the new ore feed has increased, it can be seen that the mill has traversed the curve of FIG. 1 from point 4 to point 3, in which case the set point is reduced a defined increment. Similarly, for an increase in the mill weight and decrease in the new ore feed, the mill is traversing the curve of FIG. 1 from point 3 to point 4 and again the set point is reduced. Block 55 receives input from line 71 corresponding to the weight of new media as it is added and reduces the set point to compensate for this weight. Also, block 55 reduces the set point in accordance with the wear out rate of the media and liners by information supplied by line 72. The set point as determined by block 55 is directed to controller 41 by means of lines 36.

It is noted that during the period of time when the mill weight is changing because of a change in the set point, the mill weight will not be stable and therefore the time period selected to measure the mill weight and the new ore feed weight should be a portion of time within the selected time period when the grinding system has stabilized.

While a preferred embodiment has been shown and described, it is intended to cover all modification in alternate constructions falling within the spirit and the scope of the invention as defined in the appended claims.

I claim:

1. A process for maximizing ore throughput and optimizing performance in an ore grinding system comprising the steps of weighing the ore grinding system including the drive means, weighing the new ore input to the ore grinding system, determining an optimum maximum set point weight for the ore grinding system by comparing the weight of the ore grinding system over a plurality of time periods, comparing the weight of the new ore input over a plurality of time periods, determining the ore grinding system weight set point in accordance with the difference in the ore grinding system weights and the new ore feed weights over the plurality of time periods, and regulating said new ore input such as to maintain the ore grinding system at said optimum set point weight.

2. A method for maximizing ore throughput and optimizing performance in an ore grinding system as defined in claim 1 further including the steps of determining the ore grinding system weight set point from the weights of the ore grinding system over a plurality of time periods and the weight of new ore entering the mill over a plurality of time periods in a heuristic manner.

3. A device for maximizing ore throughput and optimizing performance in an ore grinding system comprising a rotary mill, means to input new ore into the mill, means to remove ground ore from the mill, drive means to revolve the mill wherein said ore inside the mill is ground, load sensor means to weigh said mill and said drive means, load sensor means to weigh said new ore input, and controller means receiving said mill and drive means weight and said new ore input weight and controlling said mill and drive means weight at an optimum maximum weight by said new ore input so as to maximize the ore throughput, said controller means comprising a first controller and second controller, said first controller receiving the weight of said mill and drive means and said weight of said new ore input, said first controller determining a mill weight set point from said input, said second controller receiving said mill and drive means weight and said mill set point weight and thereby controlling the new ore input into the mill to keep said mill weight equal to said mill set point weight.

4. A device for maximizing ore throughput and optimizing performance in an ore grinding system as defined in claim 3 wherein said first controller receives said mill and drive means weight over a plurality of time periods and receives said new ore input weight over a plurality of time periods, said first controller comparing said mill weight over said plurality of time periods and determining the difference, said first controller comparing the new ore input over said plurality of time periods and determining the difference, and said first controller determining said mill set weight point from said mill weight differences and new ore weight differences.

5. A device for maximizing ore throughput and optimizing performance in an ore grinding system as defined in claim 4 wherein said first controller determines said set weight point in a heuristic manner.

* * * * *